US008047776B2

(12) United States Patent
Della Mora

(10) Patent No.: US 8,047,776 B2
(45) Date of Patent: Nov. 1, 2011

(54) UNIT FOR TREATING AIR WITH CONTROLLED FLOW

(75) Inventor: Pierangelo Della Mora, Codroipo (IT)

(73) Assignee: Co.Me.Fri. S.p.A., Magnano In Riviera (Udine) (IT)

( * ) Notice: Subject to any disclaimer, the term of this patent is extended or adjusted under 35 U.S.C. 154(b) by 1085 days.

(21) Appl. No.: 11/898,355

(22) Filed: Sep. 10, 2007

(65) Prior Publication Data

US 2008/0298959 A1 Dec. 4, 2008

(30) Foreign Application Priority Data

May 31, 2007 (IT) ..... VI2007A0158

(51) Int. Cl.
*F04D 17/00* (2006.01)

(52) U.S. Cl. ..... 415/203

(58) Field of Classification Search ..... 415/203, 415/204, 206, 212.1, 207, 182.1, 211.2, 224, 415/224.5

See application file for complete search history.

(56) References Cited

U.S. PATENT DOCUMENTS

2005/0238487 A1* 10/2005 Yang ..... 415/206

FOREIGN PATENT DOCUMENTS

JP 54059605 A * 5/1979

* cited by examiner

*Primary Examiner* — Richard Edgar

(74) *Attorney, Agent, or Firm* — Hedman & Costigan, P.C.; James V. Costigan

(57) ABSTRACT

A unit for treating air with controlled flow, comprising a free rotor (GL), single or double inlet, combined with a directional conveyor (CD), which is designed so as to be able to directionally exploit the high static efficiencies, typical of free rotors (GL), and so as to be able to obtain the maximum optimisation between the power supplied and the static pressure obtained, at the same time maintaining low sound emissions, low dynamic pressure values at the discharge and no perturbation of the flow and of the performances both at the discharge and at the suction.

12 Claims, 15 Drawing Sheets

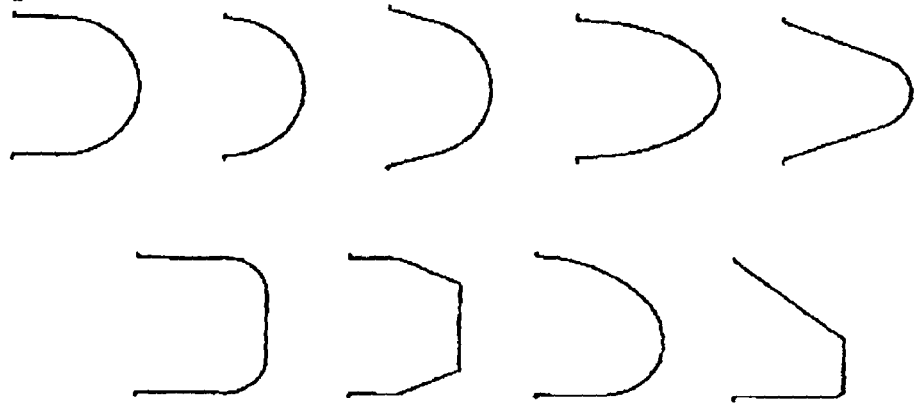
Fig. 8A Fig. 8B Fig. 8C Fig. 8D Fig. 8E
Fig. 8F Fig. 8G Fig. 8H Fig. 8I
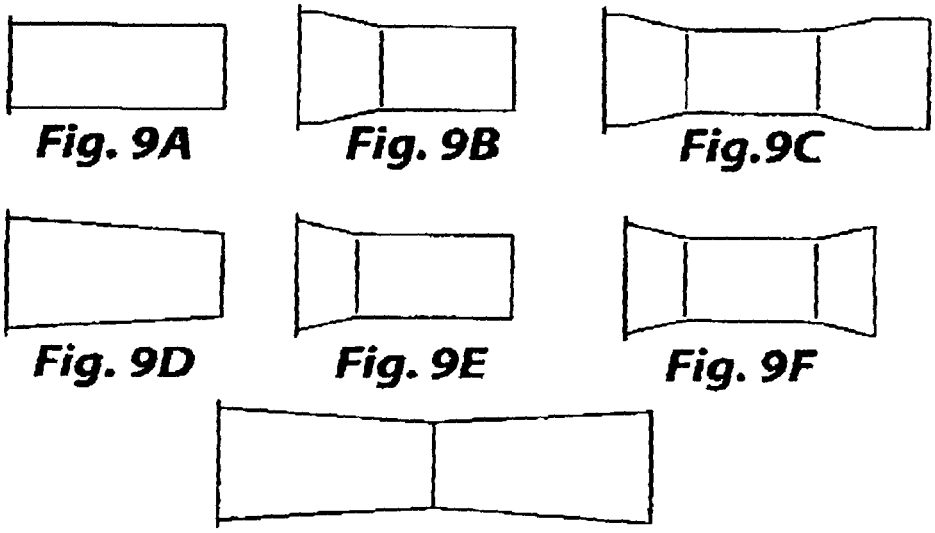
Fig. 9A Fig. 9B Fig.9C
Fig. 9D Fig. 9E Fig. 9F
Fig. 9G

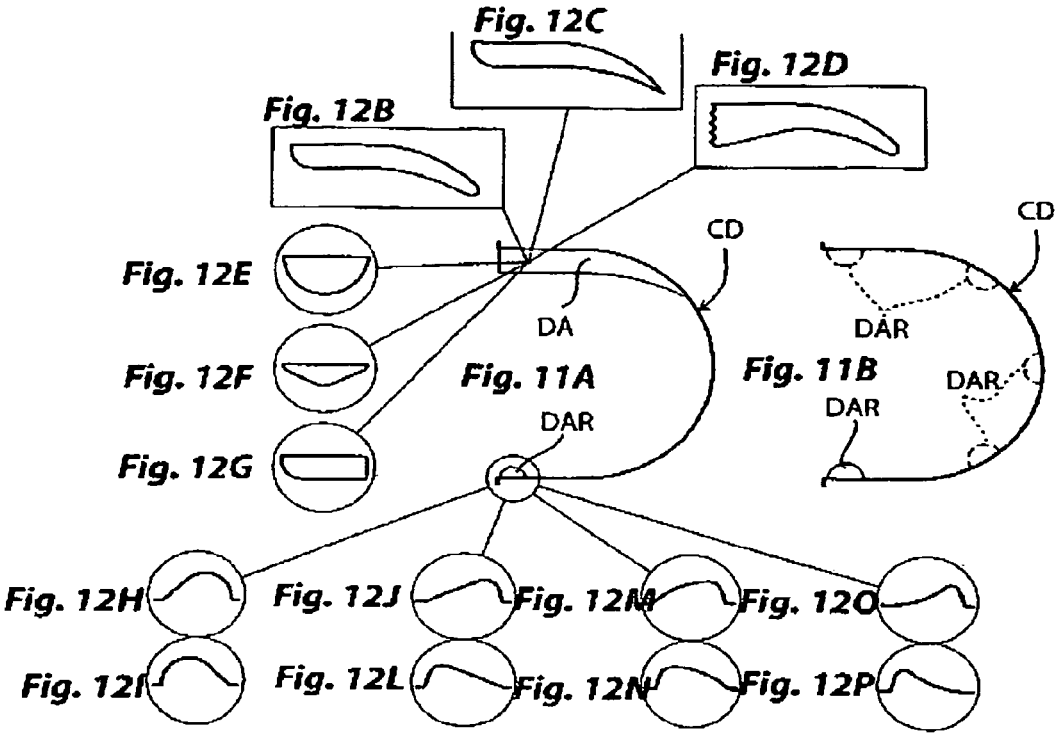
Fig. 12C
Fig. 12D
Fig. 12B
CD
CD
Fig. 12E
DA
DAR
Fig. 12F
Fig. 11A
Fig. 11B
DAR
DAR
Fig. 12G
DAR
Fig. 12H
Fig. 12J
Fig. 12M
Fig. 12O
Fig. 12I
Fig. 12L
Fig. 12N
Fig. 12P
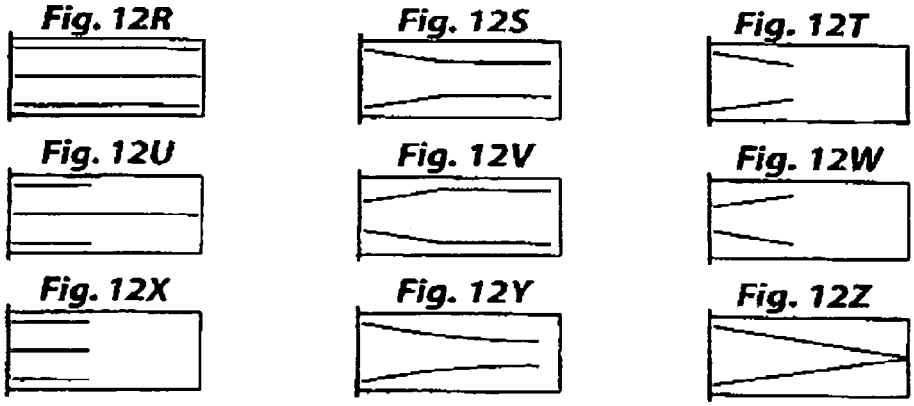
Fig. 12R
Fig. 12S
Fig. 12T
Fig. 12U
Fig. 12V
Fig. 12W
Fig. 12X
Fig. 12Y
Fig. 12Z

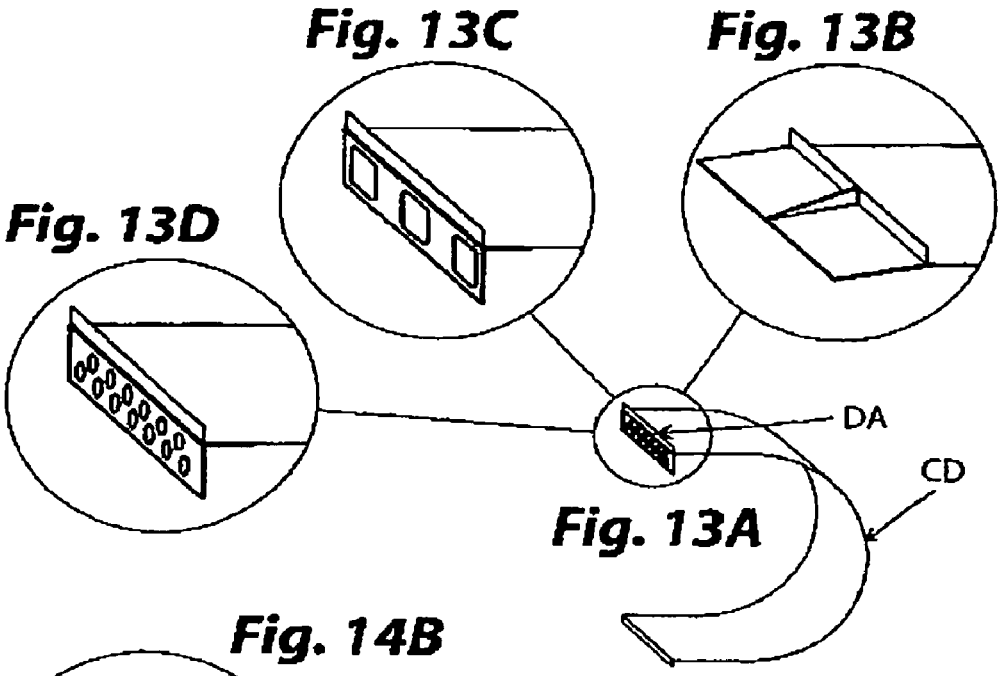
Fig. 13C
Fig. 13B
Fig. 13D
DA
CD
Fig. 13A
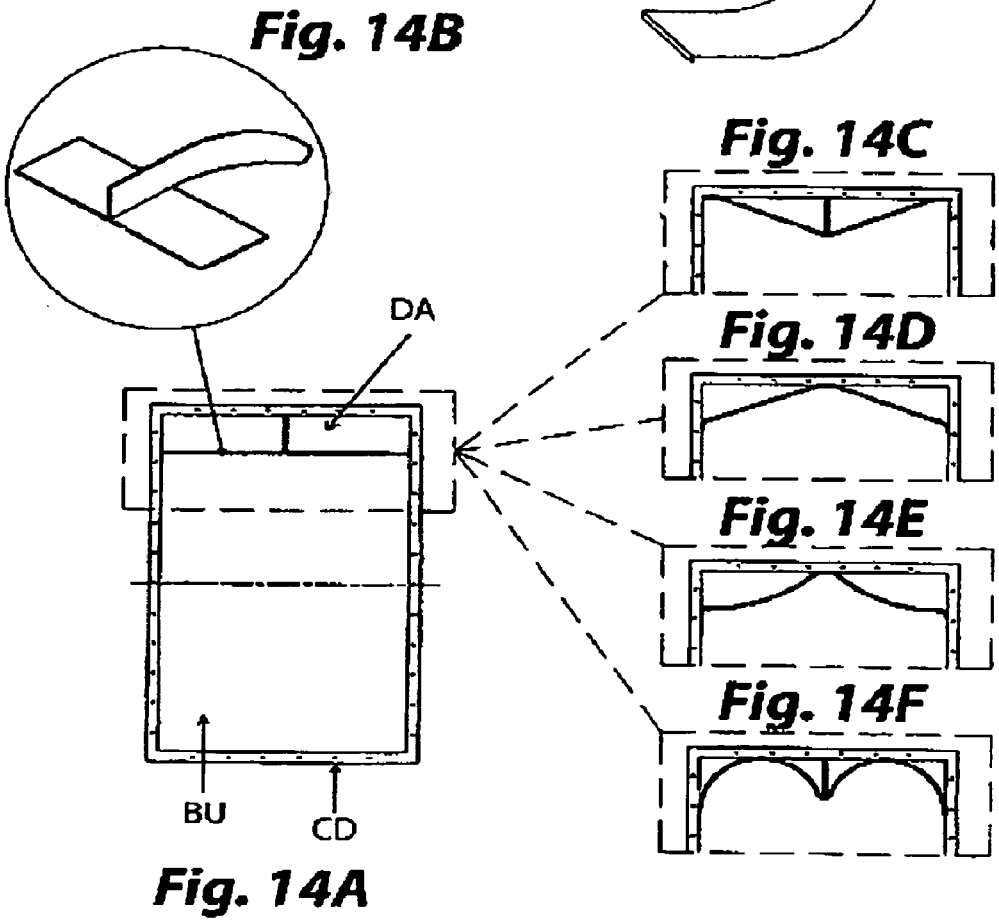
Fig. 14B
Fig. 14C
DA
Fig. 14D
Fig. 14E
Fig. 14F
BU
CD
Fig. 14A

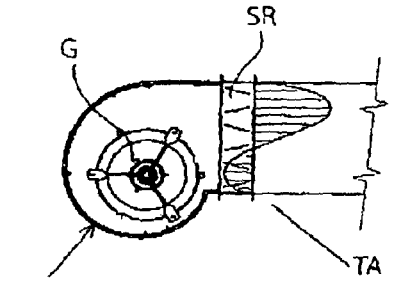
Fig. 17A
PRIOR ART
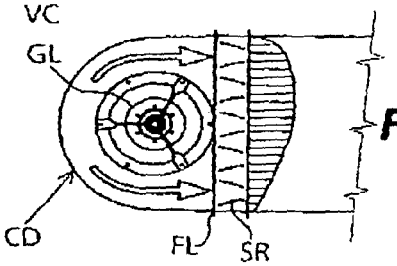
Fig. 17B
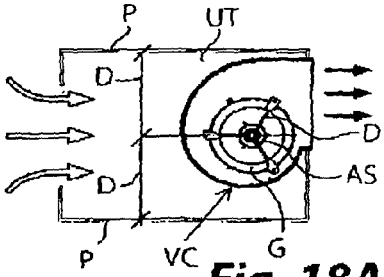
Fig. 18A
PRIOR ART
Fig. 19A
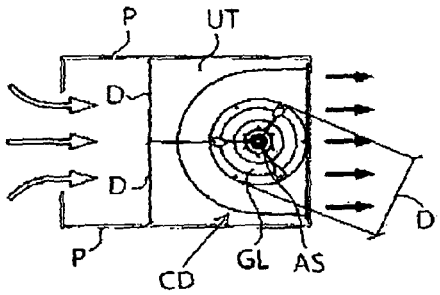
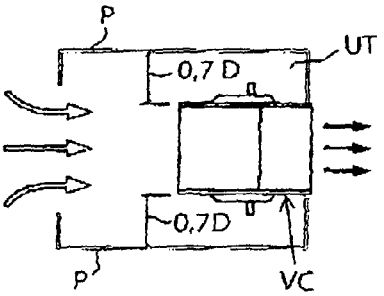
Fig. 18B
PRIOR ART
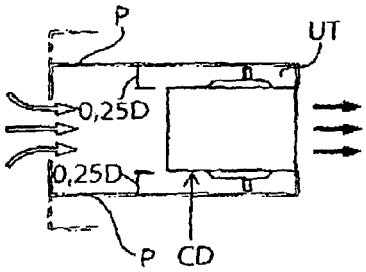
Fig. 19B

UNIT FOR TREATING AIR WITH CONTROLLED FLOW

The present invention refers to a unit for treating air with controlled flow.

In greater detail, the invention relates to application in generic units for containing fans or rather to the use of any free rotor, with single or double inlet, inside of respective directional conveyers, suitable for effectively conveying and directing the airflow generated by the free rotor.

It is known, in the field of ventilation and in particular within air treatment units UT, the use of free rotors, in other words without casing (Archimedean screw) CL, where applications require it or allow it or in relation to their aeraulic and size characteristics (an example of a free rotor GL equipped with a front disc DAN and a rear disc DPO is illustrated in the attached FIGS. 1A and 1B).

Given their widespread use, over the years there has been a process of research and development, carried out by various manufacturers, in order to offer the market with a product suitable for offering ever greater aeraulic performance, higher efficiencies and less noise emissions.

In order to obtain these results, leaving aside the morphology and inclination of the blades (part of the know-how of each manufacturer), a fairly widely used technique is to use a rotating diffuser, obtained through the use of a front disc and a rear disc of the rotor with a larger diameter than the blade diameter (see, for example, GB 207741).

The study and application of diffusers and, to be specific, of the rotating diffuser are also illustrated in some publications by B. Eck, G. Klingenberg and F. Schlender, where it is stated that slowing down the flow inside an Archimedean screw or other type of volute or directional deflector (irrespective of the type or shape), to transform part of the dynamic pressure into static pressure, is prior art and that analogous benefits are obtained by acting directly upon the rotor using a rotating diffuser.

At the same time, B. Eck also puts forward the idea that, by using a free rotor GL with rotating diffuser DF inside a conventional Archimedean screw CL characterised by a spiral-shaped geometry and with the relative necessary deflector DL (as illustrated in the attached FIGS. 2A and 2B), theoretically a fan would have been obtained that could combine the advantages of the free rotor and of the conventional fan, even if this idea remains as such, since it is not confirmed by experimental tests.

Moreover, the free rotor, as known, is not a conventional simple rotor used without Archimedean screw; this is because as the basis of its very development there is a design criterion very different to a rotor that has to work inside a casing.

The characteristic spiral-shape of a conventional Archimedean screw, indeed, is such as to allow the dynamic pressure component of the fluid to be transformed as far as possible into static pressure by the effect of the gradual increase in section, to be able to effectively use it at the outlet.

Therefore, the relative rotor must be developed, in its geometry, precisely to exploit and enhance the geometry of an Archimedean screw, achieving a balance between scroll, inlet nozzles and deflector that is delicate, but, at the same time, unique and characteristic in that particular configuration, which has the end result of a directional flow with a significant dynamic pressure component.

Therefore, it follows from this that, if such a conventional rotor is used as free rotor, poor performance would be obtained due to the lack of interaction with the Archimedean screw and, moreover, due to the occurrence of an inevitable aeraulic and acoustic stall, given by the absence of the deflector. The free rotor, on the other hand, is designed and developed so that it is their own geometries, lacking a conventional Archimedean screw, that ensures the highest possible statical performance and efficiency (a characteristic, indeed, of the free rotor), and so that the same geometries, moreover, also allow the aeraulic and acoustic stall to be avoided or at least attenuated to minimum values (lacking a conventional deflector); on the other hand, however, there is not a directional flow, but rather a radial flow.

Due to such distinct and opposite characteristics it is easy to understand how a conventional rotor cannot be used as a free rotor (due to the poor performance supplied and the occurrence of stall) and, vice-versa, how a free rotor cannot be used within a conventional Archimedean screw, which, in this case, would constitute a hindrance during the operation of the device, with the consequent non-optimal final performance.

In the aforementioned requirements, the purpose of the present invention is to avoid the aforementioned drawbacks and, in particular, to make a unit for treating air with controlled flow, which allows the flow generated by a free rotor to be optimally and effectively conveyed and directed.

Another purpose of the present invention is to make a suitable directional conveyor for free rotors with or without rotational diffuser and with single or double inlet, which is characterised by the absence of the disadvantages, already stated earlier, encountered using a free rotor arranged inside a conventional Archimedean screw.

These and other purposes are accomplished by a unit for treating air with controlled flow, according to the attached claim 1.

Advantageously, by analysing the theories put forward by B. Eck on the use of a free rotor inside a conventional Archimedean screw, its aeraulic and commercial limitations can be identified, the main ones of which are the following.

Firstly, the rotation of the diffuser implies that the encumbrance diameter of the rotor is at least one size larger than the blade diameter; this characteristic, together with the fact that, to ensure the operating conditions of the free rotor, a suitable minimum distance is need between the rotor and the inner scroll side, would force the use of a substantially large conventional Archimedean screw, making it more difficult for it to be used in units, the current tendency for which is certainly heading towards a reduction in encumbrance dimensions and consequent manufacturing costs.

Moreover, as also indicated by B. Eck, the conventional Archimedean screw, due to its operation, forces the use of a deflector, so as:

- to prevent part of the flow from going back into the Archimedean screw of the fan, by the action of the rotor, through the outlet section, at the discharge area A, generating recirculations that reduce the efficiency (the attached FIG. 3A indicates the area A and the area A' for passage of the air at the tapering of the deflector DL);
- to exploit the distance of the Archimedean screw from the rotor and the relative height, finding an optimal position for stable operation of the fan and at the same time defining a minimum distance from the rotor, in addition to which (moving closer still) the known "siren effect" is enhanced.

The deflector, however, if on the one hand is necessary and fundamental in conventional Archimedean screws (for example, applications with deflector DL, diffuser DF and flow directing means IF, as shown in the attached FIG. 3B, are known), on the other hand creates the substantial drawback of amplifying the blade tone, thus making it even more difficult, in addition to the aforementioned drawbacks of size, to use a free rotor inside a conventional Archimedean screw in installations (also in terms of its sound emissions).

Further research and analysis has also been carried out on the use of a free rotor in air treatment units UT, starting from solutions currently known and adopted, such as the rounding of the edges of the unit UT to attenuate the losses created by them (examples of free rotor GL installed in air treatment units UT, which have a rounding of the edges ASP and filters FT, are schematised in FIGS. 4A, 4B, 4C and 4D), or the use of tangential fans (VT (like in the example of FIG. 5), in other words fans used mainly in the civil sector for low/medium air flow rates, with low pressure (civil air-conditioning, home ventilation, etc.), and consisting of a wheel and of a housing, in which the rotor, aesthetically similar to that of a centrifugal fan, differs for the length and configuration of the blades and in which the air flow is directed tangent to the wheel, sucked perpendicular to the rotation axis and expelled with a variable angle of between 90° and 180°. The tangential fan VT is, however, another type of product, with known operation and geometry, also distinguished by an addition of energy to the fluid in a direction tangential to the rotor G (and not, like in the centrifugal free rotor GL shown in FIGS. 6A and 6B, through the rotor GL itself, with inlet parallel to the axis of the rotor G) and radial expulsion with change of direction inside the rotor G (as illustrated in the embodiments of the attached FIGS. 5 and 7).

Further purposes and advantages shall become clearer from the following description, relating to a preferred but not limiting example embodiment of the unit for treating air with controlled flow, which is the object of the present invention, and from the attached drawings, in which:

FIGS. 8A-8I show a series of profiles of directional conveyors that can be used to make the unit for treating air with controlled flow, according to the present invention;

FIGS. 9A-9G show a series of views from above of directional conveyors that can be used in units for treating air with controlled flow, according to the present invention;

FIGS. 11A, 11B, 13A and 14A show schematic side views of further example embodiments of directional conveyors that can be used in units for treating air with controlled flow, according to the present invention;

FIGS. 12B-12G, 12H-12J, 12L-12P, 12R-12Z, 13B-13D and 14B-14F illustrate a series of example embodiments of possible directional and anti-reflow devices that can be applied to the conveyor of the unit for treating air with controlled flow, according to the present invention;

FIG. 17A shows a schematic view of a conventional fan with damper applied directly to the discharge;

FIG. 17B shows a directional conveyor made according to the present invention with damper applied directly to the discharge;

FIGS. 18A and 18B respectively show a schematic side view and a schematic view from above of a conventional fan with typical installation in an air treatment unit;

FIGS. 19A and 19B respectively show a schematic side view and a schematic view from above of a directional conveyor with typical installation in a unit for treating air with controlled flow, according to the present invention.

Before explaining in detail the characteristics of the unit for treating air with controlled flow, according to the present invention, it should be understood that the application of such an invention is not limited to the constructive details and the arrangement of components as illustrated in the attached drawings, since the correct definition of the characteristic geometries and of the size relationships allows the design and manufacture of directional conveyors for free rotors, to be installed in the unit for treating air with controlled flow object of the invention, of whatever shape, be it in a spiral, circular, elliptical, oval, square with smoothed corners, and, at the same time, symmetrical or asymmetrical (various shapes of conveyor are illustrated in FIGS. 8A-8I, which show different side profiles, and in FIGS. 9A-9G, which show various views from above).

Figure 1A:
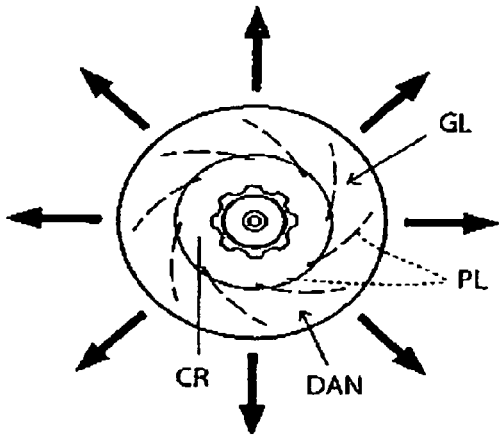
Fig. 1A PRIOR ART
FIG. 1A shows a front view of an example of a free rotor, made according to the prior art.
Figure 1B:
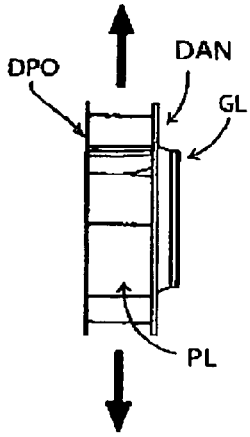
Fig. 1B PRIOR ART
FIG. 1B is a side view of the free rotor of FIG. 1A.
Figure 5:
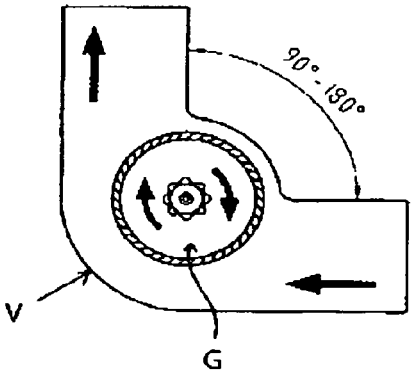
Fig. 5 PRIOR ART
FIG. 5 shows a schematic example embodiment of a conventional tangential fan.
Figure 6B:
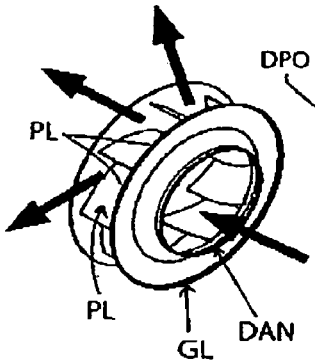
Fig. 6B PRIOR ART
FIGS. 6A and 6B show the fluid flows at the inlet and at the outlet of a centrifugal free rotor.
Figure 6A:
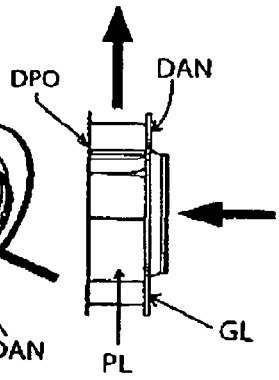
Fig. 6A PRIOR ART
Figure 2A:
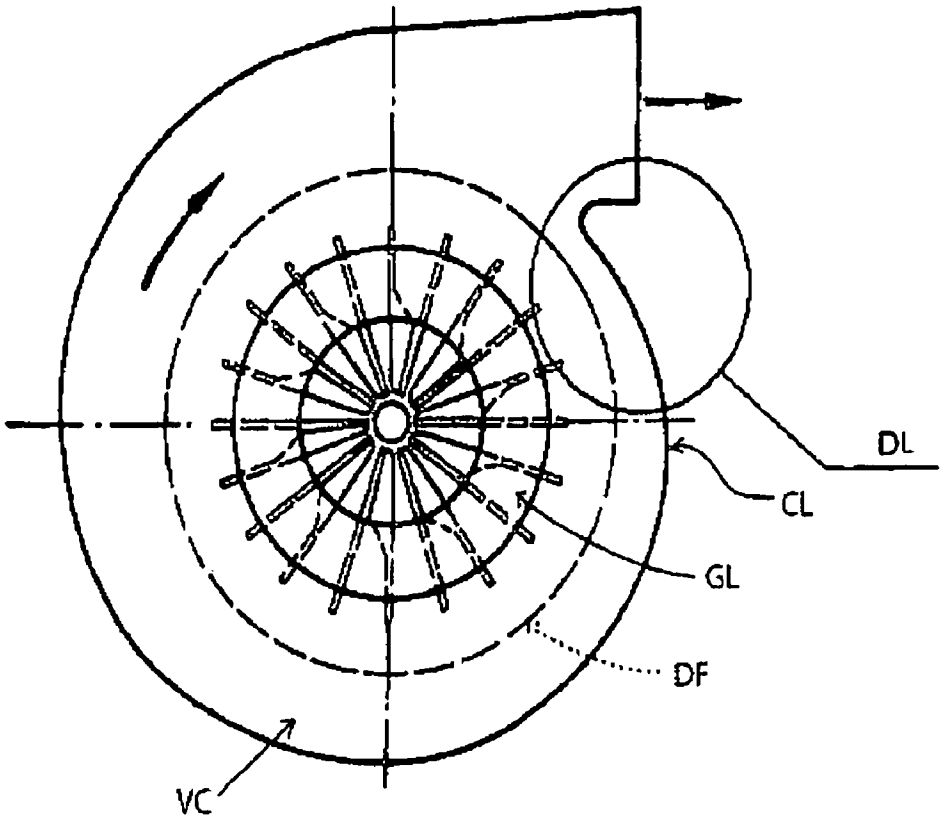
Fig. 2A PRIOR ART
FIG. 2A shows a side view of a known first embodiment of a free rotor with rotating diffuser, mounted inside a conventional Archimedean screw of a centrifugal fan, equipped with relative deflector.
Figure 2B:
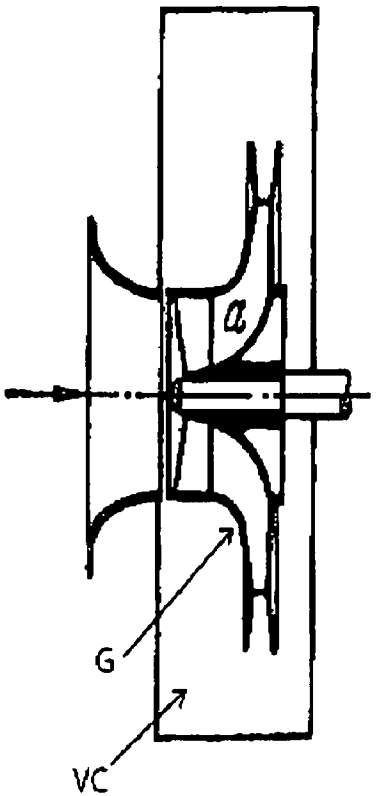
Fig. 2B PRIOR ART
FIG. 2B shows a schematic cross section of the view of FIG. 2A.
Figure 3A:
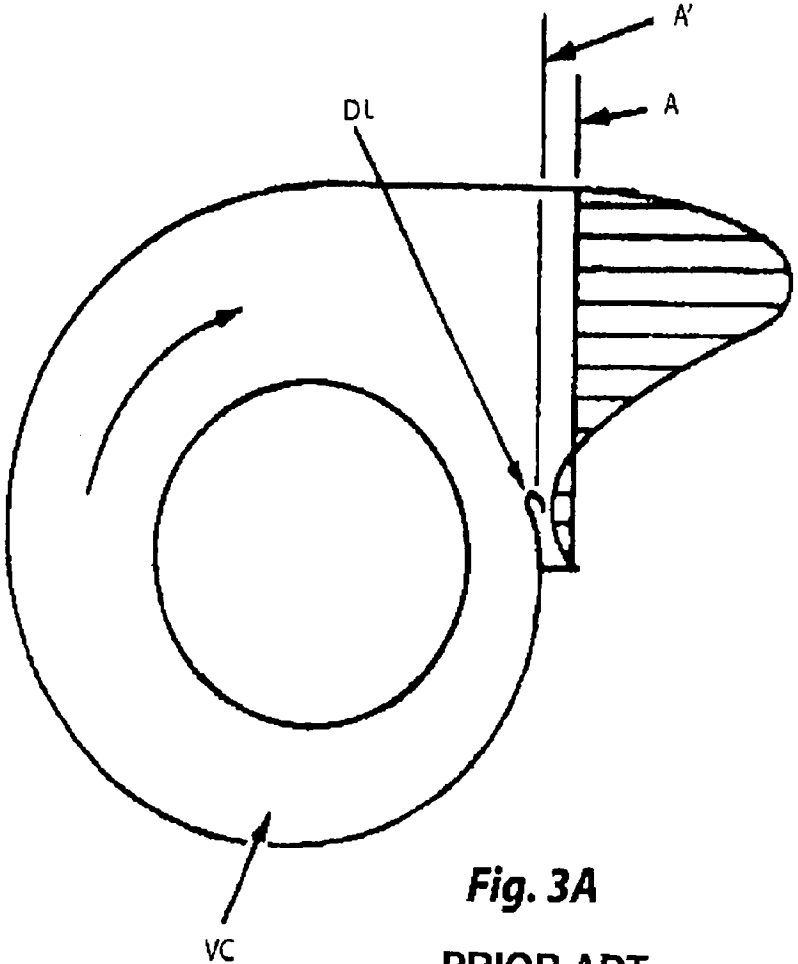
Fig. 3A PRIOR ART
FIG. 3A shows a scheme in which the area of the discharge and the blast area in conventional Archimedean screws are highlighted.
Figure 3B:
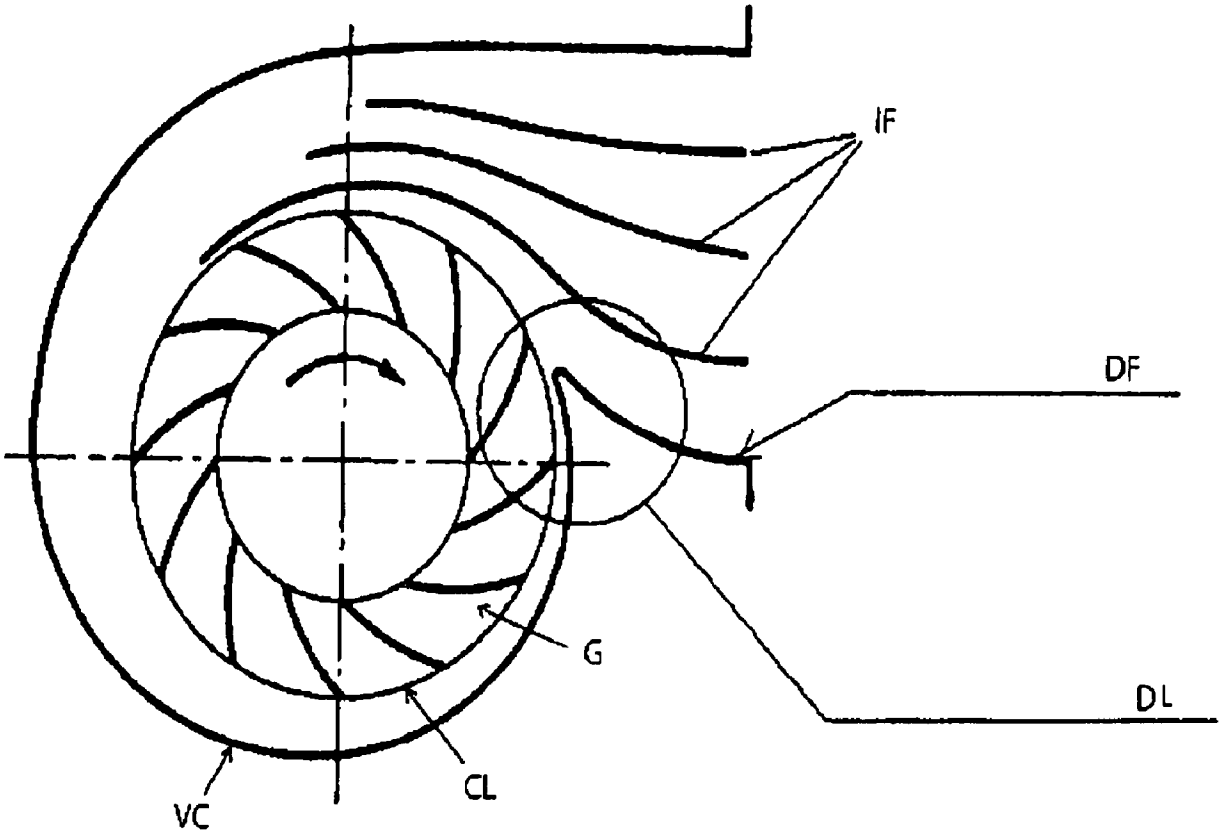
Fig. 3B PRIOR ART
FIG. 3B shows a schematic side section of a further known embodiment of a conventional rotor, mounted in a conventional Archimedean screw of a centrifugal fan.
Figure 4B:
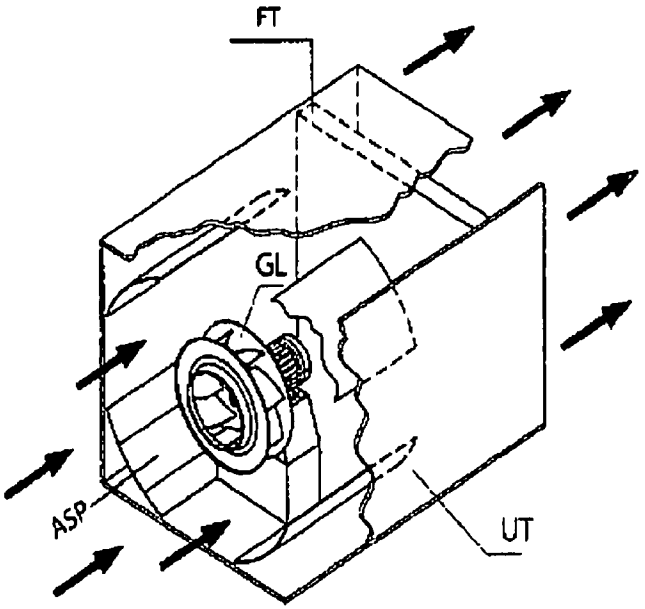
Fig. 4B PRIOR ART
FIGS. 4A-4B and 4C-4D show two known example embodiments of free rotors in air treatment units UT.
Figure 4A:
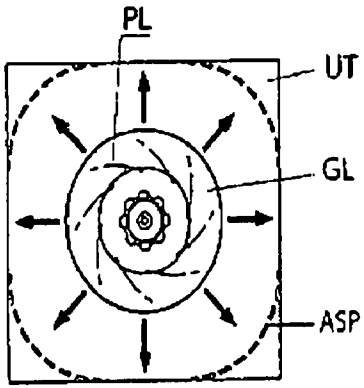
Fig. 4A PRIOR ART
Figure 4D:
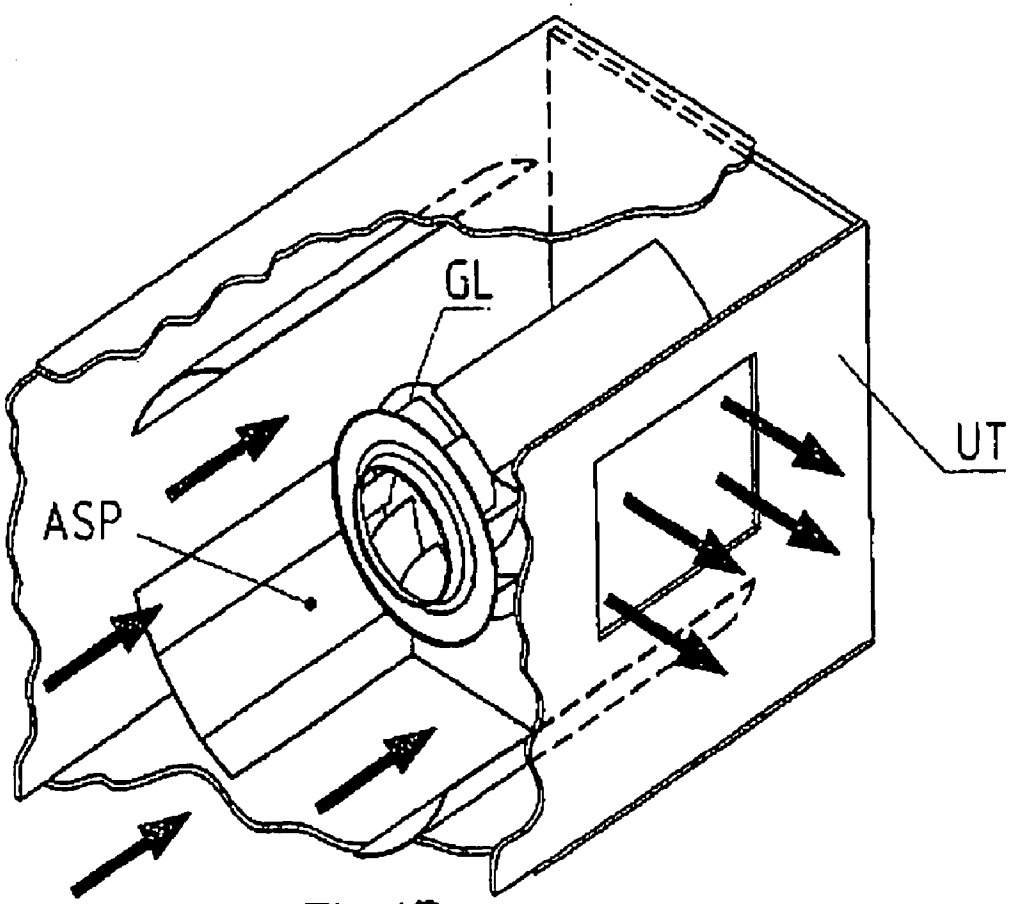
Fig.4D PRIOR ART
Figure 4C:
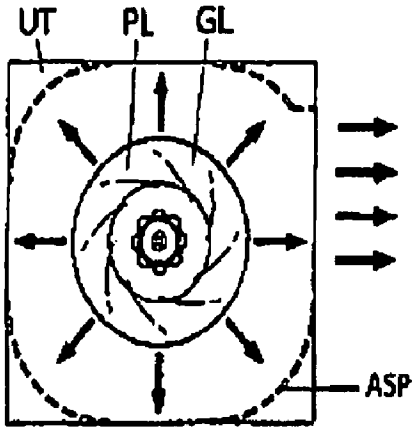
Fig. 4C PRIOR ART
Figure 7:
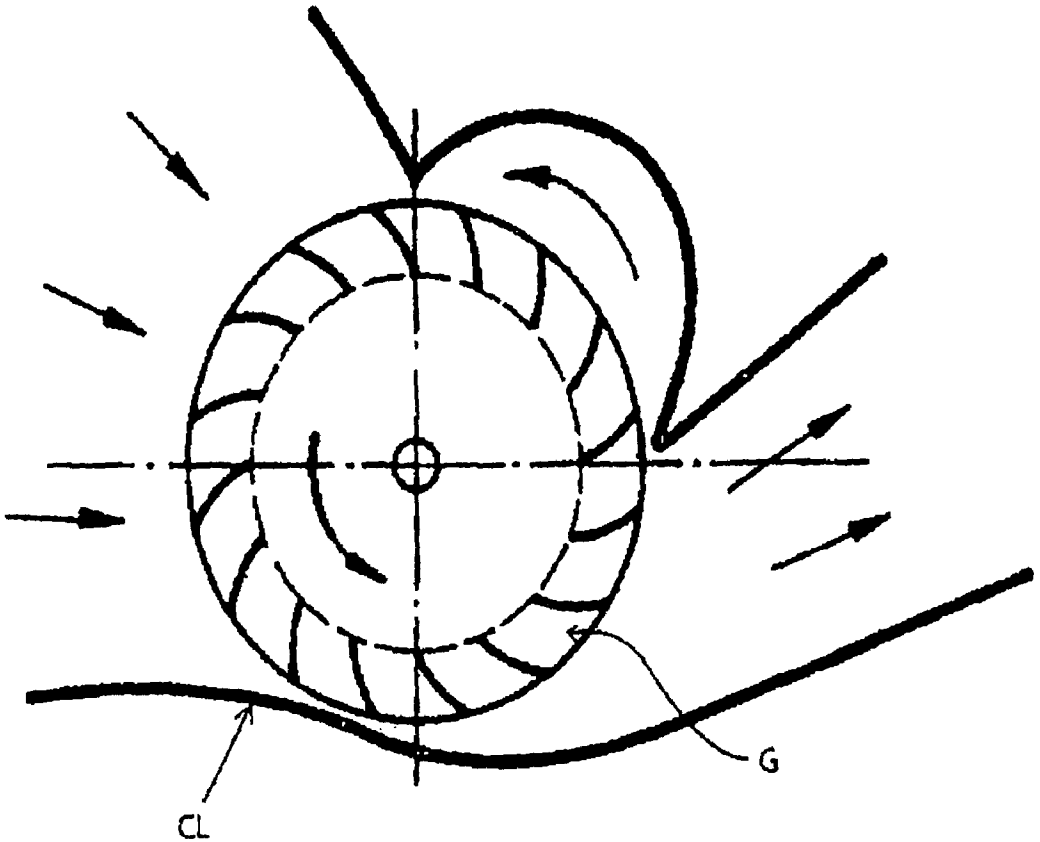
Fig. 7 PRIOR ART
FIG. 7 is a schematic view relating to the use and to the geometry of a known tangential fan.
Figure 10:
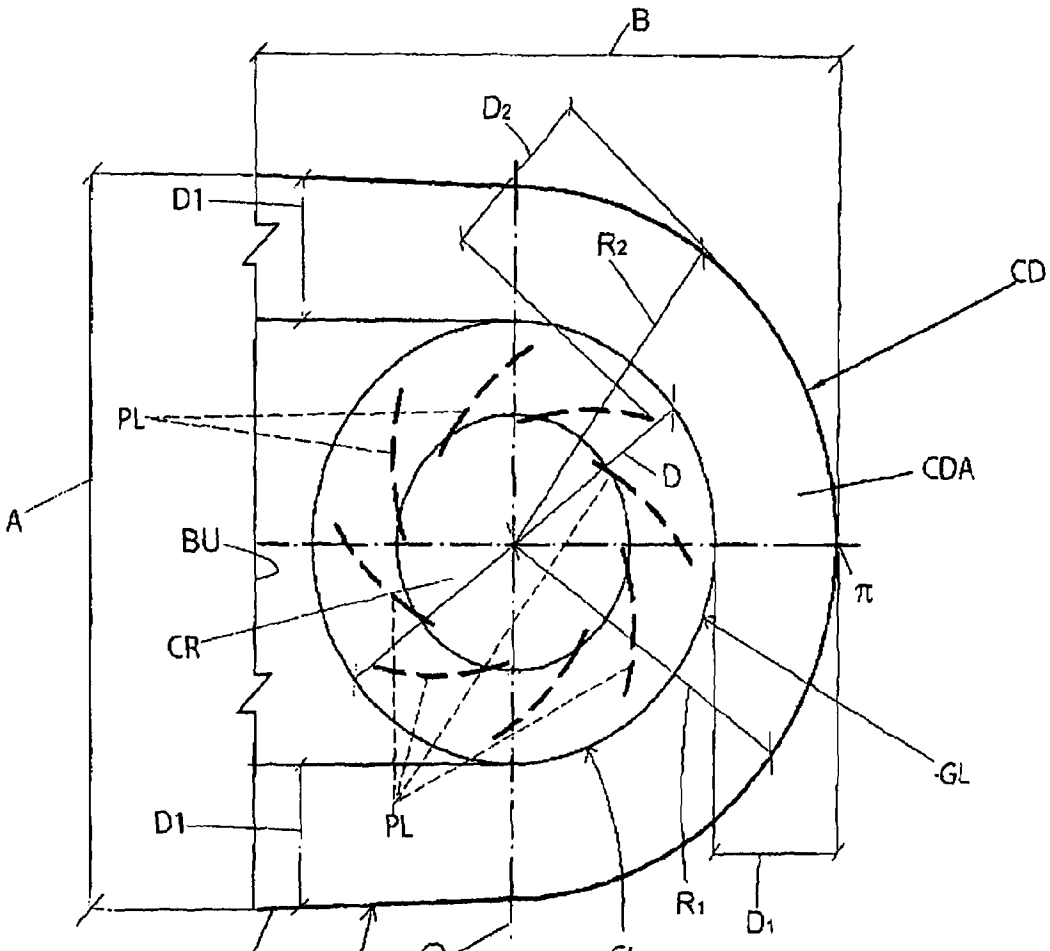
FIG. 10 shows a side view of a preferred but not limiting example embodiment of a directional conveyor that can be used in units for treating air with controlled flow, according to the present invention.

FIG. 10 shows the characteristic geometries and of the size relationships to be adopted to make the unit for treating air with controlled flow, according to the invention, known as HFW-CFW, i.e. Housed Free Wheel or Cased Free Wheel respectively, and comprising the directional conveyor CD, inside of which the free rotor GL is inserted.

Figure 12:
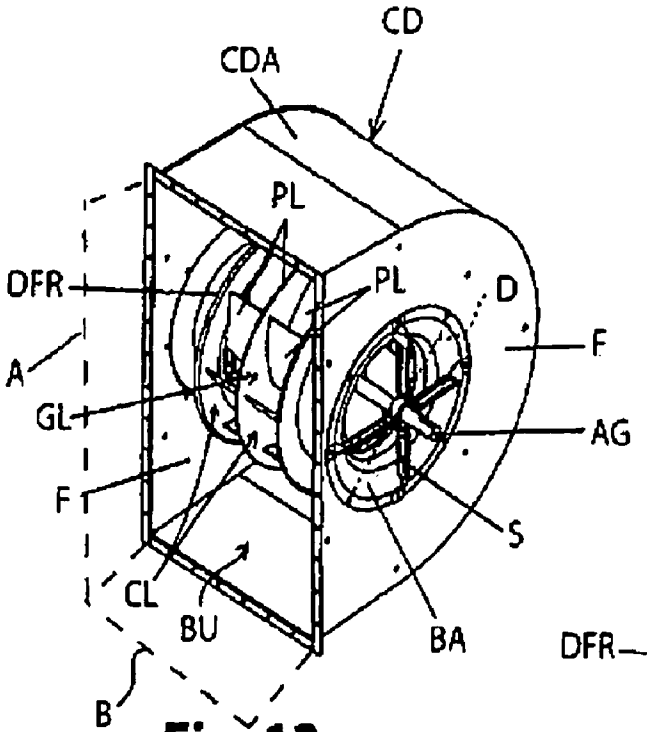
FIG. 12 shows a perspective partial view of the directional conveyor according to FIG. 10, according to the present invention.
Figure 12A:
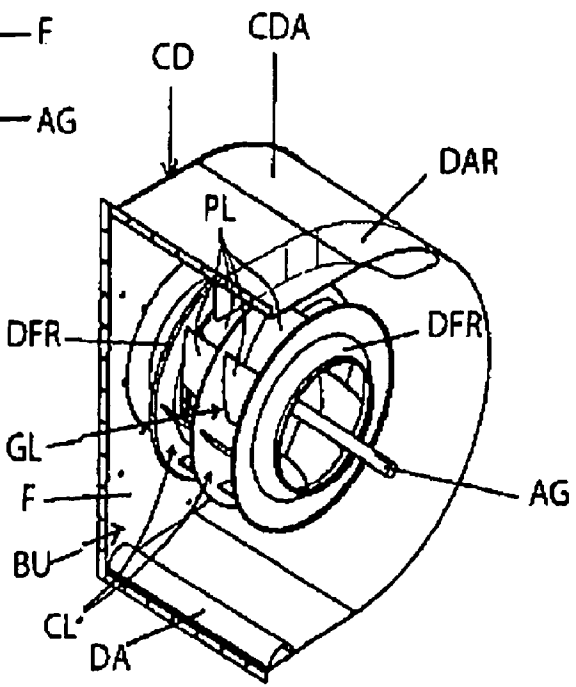
FIG. 12A shows a perspective cutaway partial view of the directional conveyor according to FIG. 10, according to the invention.

In particular, also with reference to the attached FIGS. 12 and 12A, the directional conveyor CD has an outer casing CDA, on the sides F of which the free rotor GL is inserted, which has an suction mouth BA and an discharge mouth BU corresponding to the air outlet opening of the directional conveyor CD.

The free rotor GL has a central body CR, on which one or two series of curved blades PL (single inlet or double inlet)

are mounted, and it is possibly equipped with a rotary diffuser DFR; in FIGS. 10 and 12 the diameter D of the free rotor GL is also indicated.

According to the invention, first of all, the casing CDA can have a symmetrical configuration, with respect to a horizontal plane π passing through the halfway point of the free rotor GL, or else it can have an asymmetrical configuration, with respect to the plane π, with radius of curvature R1, R2, relative to respective portions of circumference of the casing CDA included between the plane π and the plane Ω, perpendicular to π, having different dimensions, whereas, close to the discharge mouth BU and beyond the plane Ω, the casing CDA can have a profile PP that forms an angle, with respect to a horizontal trajectory perpendicular to the plane Ω, of between −45° and +45°.

Moreover, the height A and the width B of the discharge mouth BU of the conveyor CD have respective measures of between 0.5D and 3.5D and between 0.4D and 2D, whereas the edge BB of the discharge mouth BU is a distance from the plane Ω of between 0.7D and 1.6D (where D=diameter of the free rotor GL).

Moreover, the free rotor GL is inserted inside the conveyor CD at a distance D1 (intended to mean from the most projecting point of the free rotor GL, normally coinciding with the outer edge of the walls of the blades PL) from the inner walls of the casing CDA of the conveyor CD of between 0.15D and D and it is the same distance D1 (again intended to mean from the most projecting point of the free rotor GL and again between 0.15D and D) from the edge BB of the discharge mouth BU. Finally, again according to the invention, the distance D2 between the inner walls of the casing CDA of the conveyor CD and the end of each blade PL is between 0.17D and 1.12D (where D=the diameter of the free rotor GL).

The correct application of the geometric relationships indicated above allows extremely efficient directional conveyors CD to be designed and manufactured.

As is clear from the text and the attached figures, moreover, according to the invention, the conventional deflector DL of known centrifugal fans VC has been eliminated and replaced, in just the applications that require it, by suitable directional devices DA and anti-reflow devices DAR, finned conveyors, arranged inside and outside of the casing CL, as well as on the nozzles, having multiple shapes and positions, according to the outer shape of the conveyor CD, and able to be combined differently with each other.

Regarding this, two different preferred, but not limiting, example profiles of directional conveyors CD are illustrated in the attached FIGS. 11A and 11B and as many non-limiting example embodiments of directional devices DA and of anti-reflow devices DAR are illustrated in the profiles of FIGS. 12B-12J and 12L-12P, in the views from above of FIGS. 12R-12Z, in the perspective views of FIGS. 13A-13D and in the front views of FIGS. 14A-14F.

FIGS. 12 and 12A show two further perspective views, partially in cross section, of as many variant embodiments of the unit for treating air with controlled flow, according to the invention, comprising the directional conveyor CD, inside of which, at the sides F, the free rotor GL is mounted, suitable for rotating on the shaft AG, equipped with a support S, at the suction mouth BA of the free rotor GL.

In particular, FIG. 12 illustrates an air treatment unit without directional and/or anti-reflow devices, whereas FIG. 12A shows the same air treatment unit, equipped with possible directional devices DAR and with possible anti-reflow devices DA, arranged, at the top and at the bottom respectively, at the discharge mouth BU.

Moreover, with the suitable provisions, the directional conveyor CD can be made single inlet or double inlet, i.e. with single or double casing CL, in relation to requirements.

One of the main advantages obtained by using the unit for treating air with controlled flow according to the invention is that relating to obtaining the maximum optimisation between the power supplied and the static pressure obtained.

Indeed, it is known that the total pressure generated by an air treatment unit, like a fan, is, by definition, the sum of the static pressure generated and of the dynamic pressure component, which, being a function of the speed of the fluid, is destined to be lost.

As an example, in a conventional forward curved fan, in its operating point at maximum efficiency (therefore, with the least noise produced), such a component can be quantified as 15-20% of the total pressure, whereas in a treatment unit according to the invention, on the same working point (identified by the same flow rate and same static pressure), the dynamic pressure component is of the order of 3-5% of the total pressure.

Moreover, the power (equal to the energy cost) to be supplied to the unit is in any case that which is necessary to generate the total pressure, or rather to also generate its dynamic component, which shall inevitably be lost.

Therefore, it is intuitive to conclude that the smaller the dynamic component of the total pressure generated the smaller the energy component supplied (and therefore the operating cost) that will be lost.

Figure 15C:
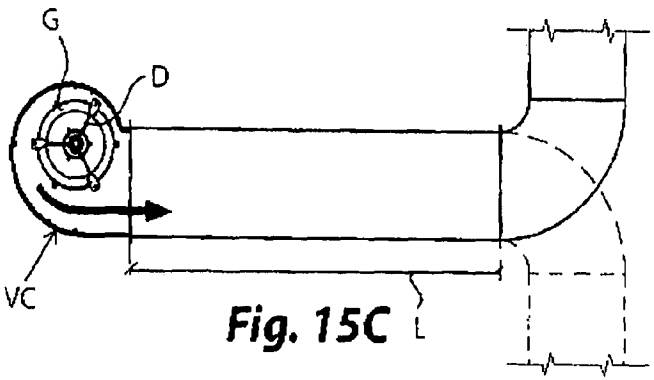
Fig. 15C PRIOR ART
FIGS. 15A-15C show schematic views of a conventional fan with outlet elbow applied directly to the discharge and/or with outlet elbow applied to the discharge in counter-rotation and/or according to a correct installation of the outlet elbow.
Figure 16B:
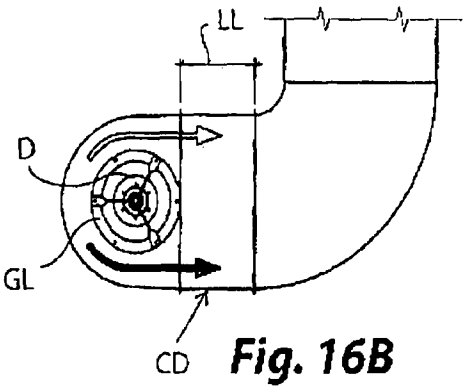
FIGS. 16A and 16B show a directional conveyor made according to the invention with outlet elbow applied directly to the discharge and/or with outlet elbow applied to the discharge in counter-rotation and/or according to an optimal aeraulic and acoustic installation.
Figure 16A:
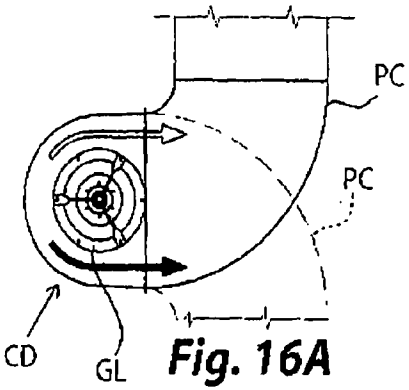
Figure 16:
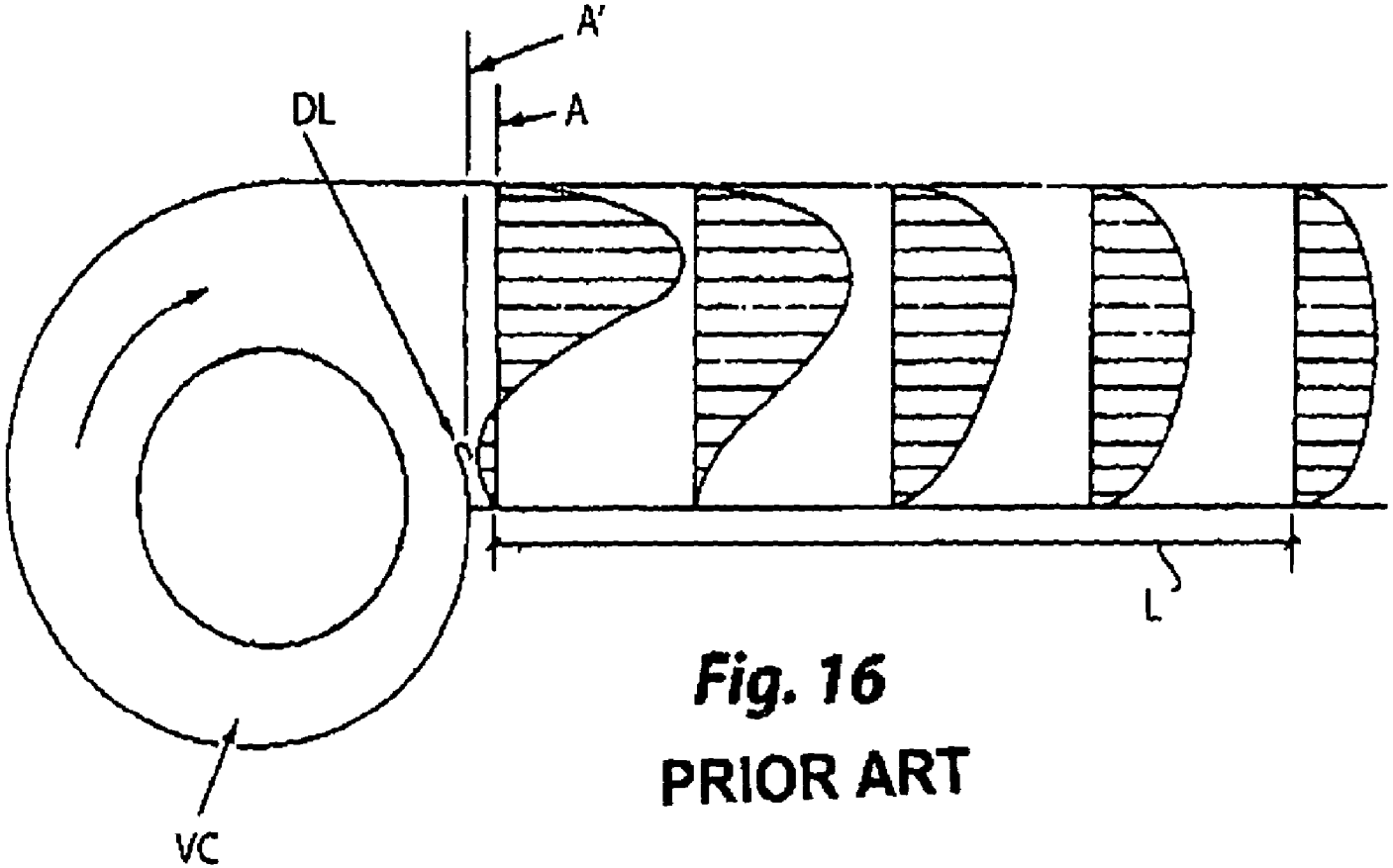
Fig. 16 PRIOR ART
FIG. 16 shows a typical velocity profile for conventional centrifugal fans.

It is also known how, in designing conventional plants, at the discharge of the centrifugal fan VC the first outlet duct portion must be kept rectilinear for a length L equal to at least 5 times the diameter D of the rotor G (see the attached FIG. 15C), since, at this distance, in the presence of a regular velocity profile, like the one shown in FIG. 16, the performance of the fan VC is not jeopardized.

Figure 15B:
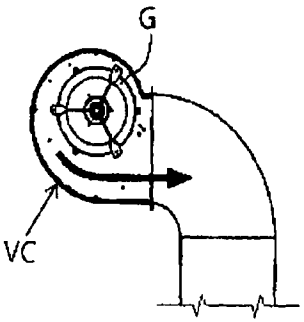
Fig. 15B PRIOR ART
Figure 15A:
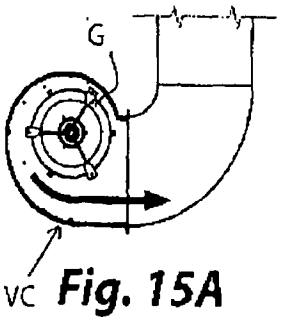
Fig. 15A PRIOR ART

Vice-versa, if such a distance is not respected and installation is carried out with an elbow applied directly to the outlet, as schematised, for example, in FIGS. 15A and 15B, drastic losses in performance are obtained even of the order of 30-40% (the greatest losses occur with the fan VC in counter-rotation, as illustrated in FIG. 15B), in relation to the type of fan VC used; moreover, in these conditions, turbulence and vorticity inevitably occur, which, together with the consequent vibrations, have the end result of a significant increase in noise.

By exploiting the aeraulic characteristics of the unit for treating air with controlled flow according to the invention, on the other hand, it is possible to significantly reduce the size of the plant, connecting the possible first elbow PC directly to the discharge with a direction independent from the direction of rotation of the free rotor GL (FIG. 16A); regarding this, for the purposes of the sound emissions, it is in any case advisable to keep a first portion of the outlet duct rectilinear for a length LL of the order of at least the diameter D of the free rotor GL (FIG. 16B). The treatment unit made according to the invention also ensures that the flow and the performances are unperturbed at the outlet, a characteristic that allows the application, directly in contact with the flange FL of the conveyor CD, of devices such as dampers for adjusting the flow SR' or similar, without creating instability and/or consequent relative possible vibrations (as shown in the attached FIG. 17B), unlike what occurs in conventional centrifugal fans VC with the damper SR applied directly on the discharge flange (FIG. 17A).

The unit according to the invention also ensures that the flow and the performances at the suction are unperturbed, so as to be able to bring possible walls. P (typical in air treatment units UT) substantially closer to the suction area AS, without causing clear losses. Indeed, it is known how one of the great limitations of the use of fans VC in air treatment units UT is due to the fact that there is a loss in performance as the distance between the walls P of the unit UT and the suction area AS of the centrifugal fan VC decreases.

Indeed, on this point we quote, as an example, the publication of AMCA standards 201-90, in which, according to the distance of the walls P of the unit UT from the suction area AS of the fan VC, there is a reference curve to be considered for calculating the theoretical performance losses.

At the time of designing current plants, in the interests of the maximum reduction in their encumbrances, the air treatment units UT are made, assuming a distance between the walls P of the unit UT and the suction area AS of the fan VC generally equal to 10.0×D (where D=the diameter of the rotor) and, in most cases, equal to 0.7×D; in practice, a performance loss of the fan estimated to be of the order of 10% is accepted if this allows a reduction in the size of the unit UT (see, on this point, the side view and the view from above of the unit UT of FIGS. 18A and 18B, respectively, in which a conventional centrifugal fan VC with typical installation in a unit UT is shown).

When, however, the spaces available on the plant do not allow the walls P to be made at a distance of 0.7×D, increasingly the walls of the unit UT are positioned at 0.5×D, with consequent significant performance losses (of the order of 20-25%, according to the type of centrifugal fan VC used) and an inevitable increase in noise.

The use of the air treatment unit according to the invention, on the other hand, makes it possible to position the walls of the unit UT even at a distance equal to 0.25×D, with a performance loss in efficiency of the order of just 3.5% and without detectable aeraulic losses, with a consequent drastic reduction in size of the unit UT (see, on this point, the side view and the view from above of the unit UT of FIGS. 19A and 19B, respectively, in which a directional conveyor CD according to the invention with typical installation in a unit UT is shown).

In any case, with the walls P of the unit UT positioned at a distance equal to 0.5×D, in a directional conveyor CD according to the invention, the only detectable losses, i.e. the efficiency losses, can be quantified as 1-2%.

Finally, for the performance provided, the treatment unit according to the invention can be used as an alternative to a normal conventional centrifugal fan VC with single or double inlet, where the performance supplied meet the required needs, but due to its characteristics, unique for their type, it has its perfect use inside air treatment units UT (like, for example, air-conditioning units, air treatment units with discharge in direct contact with electrical and gas exchangers, generic exchangers, electric boxes, fan coils, etc.), allowing substantially smaller sizes to be reached and with substantial increases in terms of efficiency and reductions in terms of costs of the plants, with respect to the use of conventional fans VC inside the aforementioned units UT.

Moreover, as there are no restrictions or limitations to their size, the air treatment units according to the invention can also be designed in small sizes and possibly used in the field of household appliances, of information technology and in all fields where a directed air flow is needed.

From the description that has been made the characteristics of the unit for treating air with controlled flow, object of the present invention, are clear, just as the advantages are also clear.

In particular, they are represented by:

- use in directional mode of the high static efficiencies typical of free rotors;
- low sound emissions produced, thanks to the elimination of the conventional deflector, the main cause of the amplification of the blade tone;
- low dynamic pressure values at the discharge and maximum optimisation between the power supplied and the static pressure obtained;
- use in counter-rotation without clear performance losses;
- no perturbation of the flow and of the performances at the discharge;
- no perturbation of the flow and of the performances at the suction.

Finally, it is clear that numerous other variants can be brought to the air treatment unit in question, without for this reason departing from the novelty principles inherent to the inventive idea, just as it is clear that, in the practical embodiment of the invention, the materials, the shapes and the sizes of the illustrated details can be whatever according to requirements and they can be replaced with others that are technically equivalent.

The invention claimed is:

1. Unit for treating air with controlled flow, comprising a centrifugal free rotor (GL), with single or double inlet and with inlet parallel to the axis of the centrifugal free rotor (GL) and radial expulsion of the air, said centrifugal free rotor (GL) having a central circular body (CR), on which at least one circular casing (CL) is mounted, equipped with backward facing curved blades (PL) and inserted inside a directional conveyor (CD), with single or double inlet, which comprises a casing (CDA) on the sides (F) of which said centrifugal free rotor (GL) is mounted, said casing (CDA) of said directional conveyor (CD) having at least one inlet or suction mouth (BA) for intaking air, said inlet or suction mouth being arranged at said sides (F) and at least one discharge mouth (BU) arranged at least one air outlet opening, said inlet or suction mouth (BA) being placed on a plane which is perpendicular to a plane containing said discharge mouth (BU) of the directional conveyor (CD), wherein said centrifugal free rotor (GL) is inserted inside said directional conveyor (CD) so that said circular casing (CL) of the centrifugal free rotor (GL) is arranged at a first distance (D1) from said casing (CDA) of the directional conveyor (CD), characterised in that said casing (CDA) of the directional conveyor (CD) is arranged at a second distance (D2) from the end of each curved blades (PL) of said central circular body (CR) of the centrifugal free rotor (GL), said first and second distances (D1, D2) being a function of the diameter (D) of said central circular body (CR) of the centrifugal free rotor (GL), so that said directional conveyor (CD) is able to directionally exploit the high static efficiencies, typical of free rotors, and to obtain the maximum optimisation between the power supplied and the static pressure obtained, at the same time maintaining low sound emissions, low dynamic pressure values at the discharge and no perturbation of the flow and of the performance both at said discharge mouth (BU) and at said inlet or suction mouth (BA).

2. Unit for treating air as claimed in claim 1, characterised in that said first distance (D1) is equal to the distance between said circular casing (CL) of the centrifugal free rotor (GL) and an edge (BB) of said discharge mouth (BU) of the directional conveyor (CD).

3. Unit for treating air as claimed in claim 1, characterised in that said centrifugal free rotor (GL) has a rotating diffuser (DFR).

4. Unit for treating air as claimed in claim 1, characterised in that said casing (CDA) of the directional conveyor (CD) has a symmetrical configuration with respect to a horizontal plane ($\pi$) passing centrally and transversally with respect to said central circular body (CR) of the centrifugal free rotor (GL) or a symmetrical configuration with a different radius of curvature (R1, R2).

5. Unit for treating air as claimed in claim 4, characterised in that said edge (BB) of the discharge mouth is placed at a distance from a vertical plane ($\Omega$) that is perpendicular to said horizontal plane ($\pi$), said distance being function of said diameter (D) of said central circular body (CR) of the centrifugal free rotor (GL).

6. Unit for treating air as claimed in claim 1, characterised in that, close to the discharge mouth (BU), said casing (CDA) of the directional conveyor (CD) has a profile (PP) that forms an angle, with respect to a horizontal trajectory, of between −45° and +45°.

7. Unit for treating air as claimed in claim 1, characterised in that said discharge mouth (BU) of the directional conveyor (CD) has a rectangular section, with respective dimensions that are functions of said diameter (D) of said central circular body (CR) of the centrifugal free rotor (GL).

8. Unit for treating air as claimed in claim 1, characterised in that directional devices (DA) and/or anti-reflow devices (DAR) are positioned at said discharge mouth (BU) of the directional conveyor (CD).

9. Unit for treating air as claimed in claim 8, characterised in that directional devices (DA) and/or anti-reflow devices (DAR) are finned conveyors.

10. Unit for treating air as claimed in claim 1, characterised in that at least one first elbow (PC) with direction independent from the direction of rotation of said centrifugal free rotor (GL) is directly connected to said discharge mouth (BU) of the directional conveyor (CD) or said first elbow (PC) is connected to the discharge mouth (BU) by means of a first rectilinear portion (LL) of a duct.

11. Unit for treating air as claimed in claim 1, characterised in that devices (SR') for adjusting the flow arc connected to said discharge mouth (BU) of the directional conveyor (CD), without creating instability and/or consequent relative possible vibrations.

12. Unit for treating air as claimed in claim 1, characterised in that at least one wall (P) is positioned close to said inlet or suction mouth (BA) of the directional conveyor (CD) at a distance which is function of said diameter (D) of said central circular body (CR) of the centrifugal free rotor (GL).

* * * * *